United States Patent [19]

Gach

[11] Patent Number: 4,727,999

[45] Date of Patent: Mar. 1, 1988

[54] SAFETY DISPENSING CLOSURE-CONTAINER PACKAGE

[75] Inventor: Peter P. Gach, Evansville, Ind.

[73] Assignee: Sunbeam Plastic Corporation, Evansville, Ind.

[21] Appl. No.: 23,832

[22] Filed: Mar. 9, 1987

Related U.S. Application Data

[63] Continuation-in-part of Ser. No. 879,487, Jun. 27, 1986, Pat. No. 4,682,702.

[51] Int. Cl.[4] ..... B65D 41/32

[52] U.S. Cl. ..... 215/232; 215/235; 215/254; 220/258

[58] Field of Search ..... 215/235, 237, 250, 254, 215/232; 220/258; 222/541

[56] References Cited

U.S. PATENT DOCUMENTS

| | | | |
|---|---|---|---|
| 3,269,617 | 8/1966 | Goth | 222/541 |
| 3,285,451 | 11/1966 | Golde | 215/320 X |
| 3,434,620 | 3/1969 | Laurizio | 220/27 |
| 3,459,315 | 8/1969 | Labarre | 215/42 |
| 3,866,782 | 2/1975 | Westfall | 215/253 |
| 3,907,146 | 9/1975 | Fields | 215/317 |
| 4,230,230 | 10/1980 | Mumford | 215/321 |
| 4,333,578 | 6/1982 | DiNunzio | 215/253 |
| 4,356,939 | 11/1982 | Fitte | 222/541 |
| 4,361,244 | 11/1982 | Walter | 215/253 |
| 4,519,517 | 5/1985 | Walter | 215/253 |
| 4,537,318 | 8/1985 | Montgomery | 215/232 |
| 4,570,811 | 2/1986 | Lecinski et al. | 215/352 X |

*Primary Examiner*—Donald F. Norton

*Attorney, Agent, or Firm*—Irvin L. Groh; Alfred L. Patmore, Jr.

[57] ABSTRACT

A safety dispensing closure and container package in which the closure is affixed to the container so that it cannot be removed, requiring dispensing through a dispensing orifice in the closure top and inhibiting refilling of the container. An internal bead on the closure skirt engages a groove in the container neck and the closure skirt extends into close proximity with a shoulder on the container neck to prevent attempts of prying removal. Tamper indication can also be provided by an integrally molded insert across the dispensing orifice which is removed by a pull tab.

15 Claims, 7 Drawing Figures

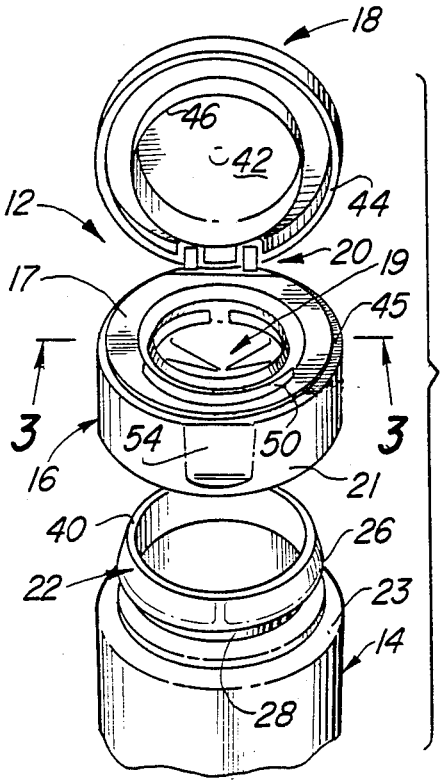
Fig-1
Fig-2
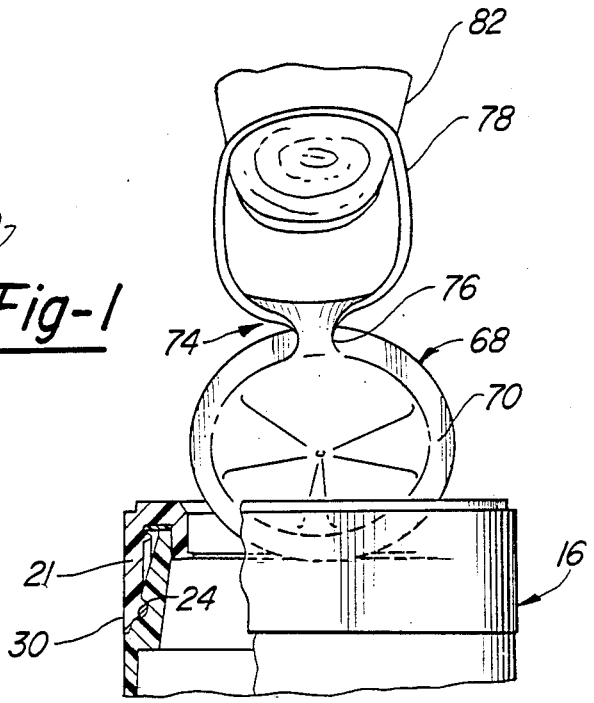
Fig-3
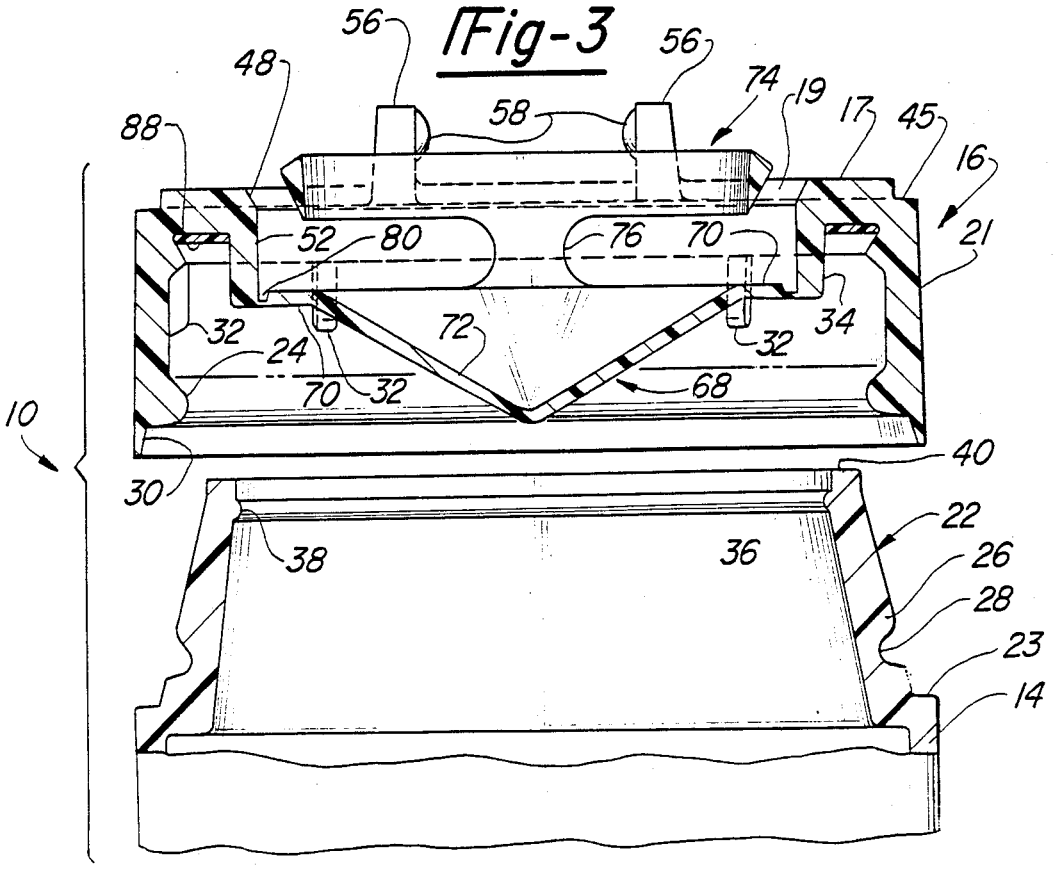

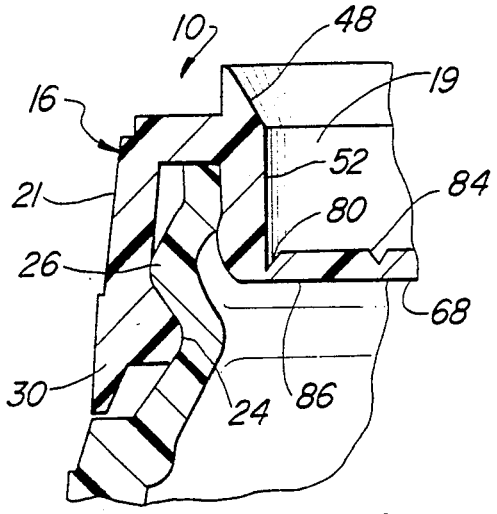
Fig-4
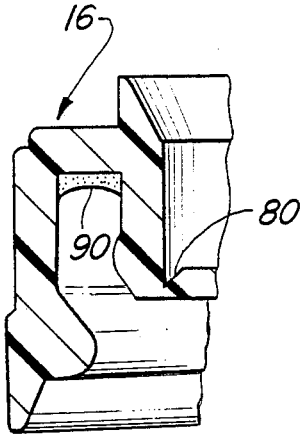
Fig-5
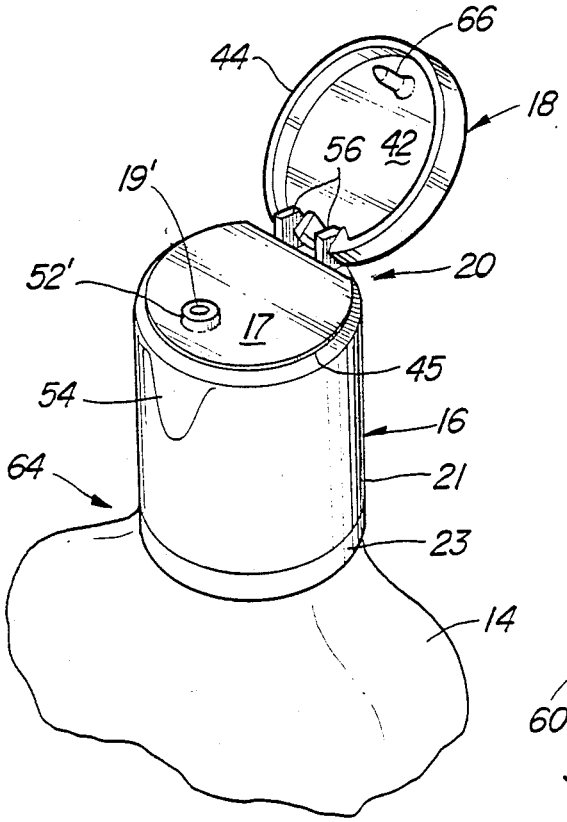
Fig-6
Fig-7
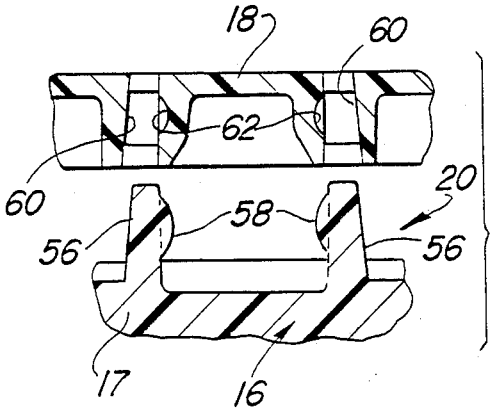

SAFETY DISPENSING CLOSURE-CONTAINER PACKAGE

This is a continuation-in-part of application Ser. No. 879,487 filed June 27, 1986, issued as U.S. Pat. No. 4,682,702, July 28, 1987.

This invention relates to a closure and container package, and, more particularly, to a safety dispensing closure and container package.

Safety closures of safety container-closure packages generally have a child resistant or tamper indicating feature or both. The child resistant feature is designed to make it more difficult for a child to open the container as by requiring, for example, a combination of successive or simultaneous movements for opening or removing the closure from the container. The tamper indicating feature is designed to make a perspective purchaser aware that the container has been previously opened or tampered.

The present invention is directed to a dispensing package in which a safety feature affixes the closure to the container so that it cannot be removed, requiring dispensing through a dispensing orifice in the cap, and in some configurations making it difficult or impossible to refill the container. Making it difficult to refill the container is desirable where the original product is a chemical substance such as a cleaning agent or a drug which could harmfully contaminate another product introduced into the container.

A second safety feature can be provided in the present invention to indicate tampering. In one embodiment, evidence of an attempt to remove the closure from the container is provided. In another embodiment evidence is provided that the dispensing orifice has been opened providing access to the contents of the container.

The foregoing purposes of this invention have been accomplished in a dispensing closure and container package in which the container has a neck with a shoulder at the base of the neck and an annular groove above the shoulder. The closure includes a base cap, lid and hinge connecting the lid to the cap. The base cap has a flat top with a dispensing orifice therethrough and an annular outer skirt which extends from the periphery of the top. This outer skirt contains an annular bead projecting inwardly for force-fitting, snap-on retention within the container neck groove. The inwardly directed bead on the cap skirt has a smaller diameter than a flange on the container neck, the smaller bead being forced over the larger flange in a snap action for retention of the base cap on the container neck.

The bottom of the outer skirt is brought in such close proximity to the container shoulder so as to prevent the insertion of a tool in an attempt to pry or remove the base cap from the container.

The base cap has an inner skirt or annular flange which is concentric with the outer skirt and extends from the cap top for sealing engagement with the container neck. The sealing engagement can be with the exterior or interior of the container neck and in most instances takes the form of a plug seal being in engagement with the inside of the container neck. The lid is movable about the hinge from a closed position covering the dispensing orifice to an open dispensing position. Thus the primary safety function is accomplished by retention of the base cap on the container neck requiring the dispensing of the product through the orifice.

The snap retention of the cap on the container neck is fortified by selecting the length of the outer cap skirt to bring the bottom of the skirt close to the shoulder discouraging attempts to remove the cap. The sealing of the base cap to the container neck by the inner skirt is independent of the retention means enhancing both sealing and retention.

A second safety function is accomplished by reducing the wall thickness of the outer cap skirt from the annular bead to the bottom of the skirt so that any attempt to remove the cap will damage or distort the bottom of the cap skirt providing visual evidence of tampering.

Another safety feature providing tamper indication is added in the form of removable sealing disk which is integrally molded with and extends across the dispensing orifice. A pull tab is attached to the disk and a weakening groove is provided in the face of the disk so that the disk can be removed by lifting the pull tab away from the container. The initial package integrity can be checked by swinging the lid open and observing the condition or absence of the sealing disk.

Other features can be added to enhance the foregoing safety features as by, for example, adding a gasket between the inner and outer skirts in contact with the cap top and the end of the container neck, serving as a secondary seal or creating a bond to enhance the snap on retention.

The preferred embodiments of the invention are illustrated in the drawing in which:

FIG. 1 is an exploded perspective view of the closure-container package arranged for snap attachment of the base cap of the closure to the container neck;

FIG. 2 is an elevational view, partially in section, showing the embodiment of FIG. 1 with the base cap firmly retained on the container neck, and with the closure lid removed for clarity to show the initial opening of the package by removal of an integrally molded insert which provides tamper indication;

FIG. 3 is a sectional elevational view along line 3—3 of FIG. 1 showing on an enlarged scale the detailes of the closure base cap and container with the lid removed for clarity;

FIG. 4 is a partial elevational view in section showing the closure cap attached to the container by the inner action of the cap bead with the container flange or groove as the embodiments of FIGS. 1–3, but showing an alternative safety sealing diaphragm or disk for tamper indication;

FIG. 5 is a partial elevational view similar to FIG. 4 showing the closure without the container and showing the use of a plastisol liner to rigidly attach the cap to the container to enhance the safety retention;

FIG. 6 is a perspective view of the closure of this invention attached to the container but with a smaller dispensing nozzle and lid plug providing a safety liquid dispensing package;

FIG. 7 is a cross-sectional enlargement taken through the hinge structure showing the means of assembly of the closure lid to the base cap.

Referring to FIGS. 1–3, package 10 is seen as including closure 12 and container 14. Closure 12 includes base cap 16 and cover lid 18 connected by a separable post and slot hinge 20. Base cap 16 has a flat top 17 with a dispensing orifice 19 therethrough and a depending cylindrical outer skirt 21. Fastening retention bead 24 extends inwardly from outer cap skirt 21 near the bottom thereof. Container 14 has a neck 22 with a shoulder 23 at the base of the neck and an annular groove 28 above the shoulder 23 formed in part by container flange 26. Closure 12 is firmly or permanently attached to container 14 by pushing base cap 16 onto container neck 22, snapping the a smaller diameter, inwardly directed cap bead 24 over a larger diameter container neck flange 26 into container groove 28.

When the base cap 16 has been assembled to container neck 22, the bottom of outer skirt 21 is in close proximity to container shoulder 23 which prevents or discourages the use of a tool such as a knife or screwdriver in an attempt to remove base cap 16 from container 14. The cap skirt 21 has a reduced wall thickness flange 30 at its bottom. Should an attempt be made to remove the cap 16 with a tool, flange 30 will be damaged or distorted providing evidence or tampering. Preferably, base cap 16 is molded with polypropylene providing a resilient structure for snap connection to the container, and any prying will distort or partially tear the flange 30. If a harder or more brittle material is used such as a high density polyethlyene for greater thread retention, such prying will be evidenced by chipping or breaking off portions of flange 30. Circumferentially spaced, longitudinally extending stiffening ribs 32 are provided between the cap top 17 and bead 24, particularly where a more resilient material is used, to provide additional resistance if an attempt is made to distort the cap for removal.

Base cap 16 is provided with inner skirt or annular plug 34 for sealing engagement with interior or exterior of container neck 22. Typically, this engagement would be with interior surface 36 of neck 22 as shown in FIGS. 2 and 3, and this sealing can be enhanced by the use of sealing bead 38 projecting inwardly from the interior neck surface 36 adjacent to the neck end 40.

Hinge 20 allows movement of the lid 18 from an open dispensing position as shown in FIGS. 1 and 6 to a closed position covering dispensing orifice 19. Lid or cover 18 has a flat top 42 and a depending skirt 44 which engages base cap rim or groove 45 for retention of the lid on the cap in its closed position presenting an aesthetically pleasing flush blending of the lid skirt 44 into outer cap skirt 21. Dispensing orifice 19 is sealed when the lid 18 is in its closed position by an annular plug 46 depending from flat lid top 42. A pouring lip 48 around dispensing orifice 19 is established by an outwardly extending bevel, and this lip and upstanding semi-circular guide lip 50 direct the lid plug 46 into the dispensing orifice 19.

The interior 52 of inner skirt 34 serves as a nozzle extension 52 of the dispensing orifice 19 and provides a coacting sealing surface with plug 46. Outer cap skirt 21 can be provided with an indentation for finger access to push lid 18 open.

Post and slot hinge 20 not only provides easy separation of the lid 18 and cap 16 and the advantage of forming the lid and cap separately with less complex molds, allowing the use of different material and color combinations between the lid and cap but also provides a hinge which is hidden in a closed condition to further enhance the aesthetic appearance of the package. This hinge structure, as shown more fully in FIGS. 3, 6 and 7, includes a pair of spaced apart posts 56 which project upwardly from cap top 17 or from the hinge area enlargement of cap groove or recess 45. Posts 56 are provided with curvilinear projections 58 which are in-line with each other and the centers of which establish a hinge axis. The lid 18 is provided with a wall structure defining a pair of complementary slots 60, and each slot has a complementary aligned curvilinear indentation 62. The lid slots and curvilinear indentations receive the cap posts and mating curvilinear projections establishing the working hinge 20. The curvilinear projections 58 can take a semi-spherical shape or other shape such as a cylindrical shape so long as they provide complete swinging action with the corresponding indentations 62. Likewise, the projections may be facing each other as shown in FIG. 7 or they may be facing away from eath other, or even on one side on one post and the other side on the other post so long as they are on a common pivotal axis. It should also be noted that the posts can be located on the lid and the slots located on the base cap to perform the same equivalent function. The foregoing hinge structure is set forth in more detail in co-pending U.S. patent application, Ser. No. 825,464 filed Feb. 3, 1986, now U.S. Pat. No. 4,666,068.

While safety package 10 with snap closure retention in shown in FIGS. 1-3 as applied to a wide mouth dispensing orifice 19, the same principles are used in the package 64 shown in FIG. 6. Here the dispensing orifice 19′ is shown surrounded by an upstanding nozzle collar 52′, and the lid 18 is provided with a cylindrical plug 66 for sealing coaction with the dispensing orifice in the closed position of the lid. The dispensing orifice 19′ is off center but still remains in line with hinge 20 as by being positioned on a line perpendicular to the pivot axis of the hinge.

To provide virtual hermetic sealing of the package and to provide a tamper indicator, removable sealing disk 68 can be molded integrally with the base cap 16 extending over the dispensing orifice 19. In the embodiments of FIGS. 1-3 and FIG. 4 sealing disk 68 is located adjacent to the bottom of inner skirt 34 projecting inwardly from interior wall surface 52. In the embodiment of FIGS. 1-3, disk or membrane 68 is formed with a flat annular portion 70 the outside of which is contiguous with and joined to internal wall 52 of skirt 34. The disk 68 further includes a central conical section 72 which extends from annular portion 70 downwardly into container neck 22. Pull tab 74 is attached to sealing disk 68 as by post 76 which is attached at one end to annular portion 70 of sealing disk 68, with the other end of the post being formed with a finger pull ring 78. A weakening groove 80 is molded in the face of disk 68 to provide a frangible break area when the pull ring 78 is lifted by the user's finger 82 as shown in FIG. 2. In the embodiments of FIGS. 1-3, this weakening groove is contiguous with the periphery of the orifice 19 or the inner wall 52 of inner skirt 34. The conical central portion 72 of the disk provides structural rigidity so that a clean tear or break occurs when ring 78 is lifted. In the embodiment of FIG. 4, the sealing disk 68 is shown as a planar disk across dispensing orifice 19, and an additional groove 84 forms an overall spiral groove 80, 84 so that as the finger ring 78 is lifted, the sealing disk is first removed as a spiral strip 86 as more fully described in my co-pending U.S. patent application, Ser. No. 879,487, filed June 27, 1986.

A gasket 88 can be located between inner skirt 34 and outer skirt 21 in contact with base cap top 17 and top 40 of container neck 22 to provide a secondary seal of the closure 12 to container 14 or it may provide a more rigid connection of the cap to the container neck. When the gasket 88 is made of a resilient material, it will be compressed between the neck end 40 and the cap top 17 when the base cap is snapped onto the container neck. The gasket can also be formed after molding of the base cap as by pouring a hot melt material 90 between the inner and outer skirts in contact with the base cap top as shown in FIG. 5. This material can be the type of plastisol which when allowed to cool, will set up and may be of a further composition to provide a clinging bond to the cap top 17 and the container neck top 40.

The embodiments of the invention in which an exclusive property or privilege is claimed are defined as follows:

1. A safety dispensing closure and container package comprising, in combination: a container having a neck with a shoulder at the base of the neck and an annular groove above said shoulder; a closure including a base cap, a lid, and a spaced apart post and slot hinge connecting said lid to said base cap permitting separate molding of said base cap and lid and assembly together at said hinge; said base cap having a flat top with a dispensing orifice therethrough and an annular outer skirt extending from the periphery of said top, said outer skirt having an annular bead projecting inwardly therefrom for force-fitting, snap-on retention within said container neck groove, said skirt having a length that when said base cap is snapped onto said container neck, the bottom of said outer skirt will be in such close proximity to said shoulder so as to prevent the insertion of a tool in an attempt to remove said base cap from said container; said base cap having an inner skirt concentric with said outer skirt extending from said cap top for sealing engagement with said container neck; and said lid being movable about said hinge from a closed position covering said orifice to an open dispensing position.

2. The safety dispensing package of claim 1 wherein said outer cap skirt has a reduced wall thickness from said annular bead to the bottom thereof whereby any attempt to remove said base cap from said container by prying between the bottom of said cap skirt and said container shoulder will distort the bottom of said cap skirt to provide evidence of tampering.

3. The safety dispensing package of claim 1 wherein said inner skirt is in the form of an annular plug the exterior of which sealingly engages the inside of said container neck.

4. The safety dispensing package of claim 3 wherein the interior of said annular plug forms a nozzle extension of said dispensing orifice.

5. The safety dispensing package of claim 3 wherein said container neck has an internal bead adjacent its open end which sealingly engages said annular plug.

6. The safety dispensing package of claim 1 further including a gasket located between said inner and outer skirts in contact with said base cap top and the end of said container neck.

7. The safety dispensing package of claim 6 wherein said gasket is resilient whereby when said base cap is snapped onto said container neck, the end of said container neck will engage and compress said gasket against said cap top.

8. The safety dispensing package of claim 6 wherein said gasket is formed after said closure has been molded by pouring a hot melt material between said inner and outer skirts in contact with said base cap top.

9. The safety dispensing package of claim 6 wherein said gasket forms a bond with said cap top and the end of said container neck to enhance retention of said cap on said container.

10. The safety dispensing package of claim 1 further including a cylindrical plug extending from said lid for sealing engagement with said dispensing orifice when said lid is in its closed position.

11. The safety dispensing package of claim 1 further including a removable sealing disc integrally molded with and extending across said dispensing orifice; a weakening groove in the face of said disc adjacent the periphery of said orifice; and a pull tab attached to said disc on the inner side of said groove; whereby said sealing disc can be removed by gripping said pull tab and lifting it away from said container, and the initial package integrity can be checked by swinging said lid open and observing the condition or absence of said sealing disc.

12. The safety dispensing package of claim 11 wherein said pull tab is formed as a post, one end of which is attached to said disc and the other end of which is attached to a finger pull ring and further including an annular plug extending from the lid for sealing engagement with said dispensing orifice and confining said post and pull ring when said lid is in its closed position.

13. The safety dispensing closure of claim 11 wherein the weakening groove in said disc is contiguous with the periphery of said orifice and wherein said disc is formed with a flat annular portion, the outside of which is contiguous with said groove, and in which said pull tab is attached, said disc further including a central conical section extending from said annular portion with its apex extending into the container neck, thereby stiffening said disc and providing easy fracture at said weakening groove when said pull tab is lifted for removal of said disc.

14. The safety dispensing closure of claim 1 wherein post and slot hinge includes a pair of spaced apart posts projecting from the top of said cap, each post being provided with one of a curvilinear projection and curvilinear indentation, and wall means forming a pair of complementary slots in said lid, each slot having one of a complementary curvilinear projection and curvilinear indentation in its associated wall means, said slots receiving said post with mating curvilinear projections and indentations being aligned with each other.

15. A safety dispensing closure and container package comprising, in combination: a container having a neck with a shoulder at the base of the neck and an annular groove above said shoulder; a closure including a base cap, a lid, and a hinge connecting said lid to said base cap; said base cap having a flat top with a dispensing orifice therethrough and an annular outer skirt extending from the periphery of said top, said outer skirt having an annular bead projecting inwardly therefrom for force-fitting, snap-on retention within said container neck groove, said skirt having a length that when said base cap is snapped onto said container neck, the bottom of said outer skirt will be in such close proximity to said shoulder so as to prevent the insertion of a tool in an attempt to remove said base cap from said container, said outer cap skirt also having a reduced wall thickness from said annular bead to the bottom thereof whereby any attempt to remove said base cap from said container by prying between the bottom of said cap skirt and said container shoulder will distort the bottom of said cap skirt to provide evidence of tampering; a plurality of circumferentially spaced, longitudinally extending strengthening ribs projecting inwardly from said outer skirt located between said cap to and said annular bead; said base cap having an inner skirt concentric with said outer skirt extending from said cap top for sealing engagement with said container neck; and said lid being movable about said hinge from a closed position covering said orifice to an open dispensing position.

* * * * *